US007513809B2

(12) United States Patent
Kubinski

(10) Patent No.: US 7,513,809 B2
(45) Date of Patent: Apr. 7, 2009

(54) OUTBOARD MOTOR TILT ACTUATOR WITH SHOCK DAMPING FEATURE

(75) Inventor: Paul T. Kubinski, Brooklyn Park, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 101 days.

(21) Appl. No.: 11/278,864

(22) Filed: Apr. 6, 2006

(65) Prior Publication Data

US 2006/0240722 A1 Oct. 26, 2006

Related U.S. Application Data

(60) Provisional application No. 60/668,885, filed on Apr. 6, 2005, provisional application No. 60/694,405, filed on Jun. 27, 2005.

(51) Int. Cl.
*B63H 5/125* (2006.01)

(52) U.S. Cl. ..... 440/61 T

(58) Field of Classification Search ..... 440/61 T; 91/422

See application file for complete search history.

(56) References Cited

U.S. PATENT DOCUMENTS 1,445,615 A 2/1923 Ferres
2,729,308 A 1/1956 Koski et al.
2,927,552 A 3/1960 Mickey
4,768,629 A 9/1988 Wössner
4,782,925 A 11/1988 Grundei
5,195,914 A 3/1993 Binversie et al.
5,333,708 A 8/1994 Jensen et al.
6,814,193 B2 11/2004 Grundei
7,128,625 B2 * 10/2006 Saito ..... 440/61 T
2005/0090163 A1 4/2005 Saito

* cited by examiner

*Primary Examiner*—Ed Swinehart
(74) *Attorney, Agent, or Firm*—Renner, Otto, Boisselle, & Sklar, LLP

(57) ABSTRACT

A tilt actuator for an outboard motor wherein shocks acting on the actuator are initially dissipated at a first damping rate and then at a higher damping rate near the end-of-stroke of the actuator's piston. The tilt actuator comprises a cylinder, a piston, a piston rod and a damper member, the latter being cooperative with the piston in a first position to at least partially block at least one of plural damping passages in the piston thereby to restrict flow of fluid from the first chamber to the damping passages in the piston and in a second position that allows full damping flow of fluid to the inlet openings of the damping passages from the first chamber to the damping passages in the piston during movement of the piston in the second direction.

7 Claims, 6 Drawing Sheets

OUTBOARD MOTOR TILT ACTUATOR WITH SHOCK DAMPING FEATURE

RELATED APPLICATION

This application claims the benefit of U.S. Provisional Application No. 60/668,885 filed Apr. 6, 2005, and U.S. Provisional Application No. 60/694,405 filed Jun. 27, 2005, both of which are hereby incorporated herein by reference in their entireties.

FIELD OF THE INVENTION

The invention herein described relates generally to tilt actuators for an outboard boat motor having a staged damping feature that protects against high end-of-stroke shocks when the motor pops up in response to striking an underwater obstruction.

BACKGROUND

Many outboard motors are equipped with a tilt and trim mechanism for tilting the motor to an up position for launching, retrieving, servicing or trailering, and for tilting the motor to a down position for use in propelling a marine vessel such as a boat. During boat operation the tilt and trim mechanism can be used to adjust the trim of the motor for optimum boat performance and handling, or for other reasons such as shallow water. Such mechanisms typically include a DC motor driven hydraulic pump and one or more hydraulic piston-cylinder assemblies connected between a mounting bracket, such as a clamp, that is secured to the transom of the boat and a motor mount that is pivotally connected to the mounting bracket.

During normal operation the lower end of the motor's drive shaft housing will extend to a level lower than the bottom of the boat where it might encounter an underwater obstruction such as a submerged log or rock. To protect the motor from damage, and particularly the propeller at the bottom end of the drive shaft housing, a hydraulic tilt piston-cylinder assembly is provided with a shock absorbing/dampening feature that allows the motor to pop up and clear of the underwater obstruction. This is typically provided by pressure relief valves built into the piston of the assembly. A problem arises if the rapid pressure buildup in the assembly causes the piston to bottom out and transfer large loads to the motor's structural components with resultant damage to such components.

Attempts have been made to provide a hydraulic tilt piston-cylinder assembly that reduces the shock at the end of travel of the piston. One such attempt is disclosed in U.S. Patent Application Publication No. 2005/0090163 wherein a spring-biased oil lock piston defines with the cylinder wall an annular restricted flow path that meters the flow of hydraulic fluid therepast as it is being pushed by primary piston in the cylinder.

SUMMARY OF THE INVENTION

The present invention provides a tilt actuator for an outboard motor wherein shocks acting on the actuator are initially dissipated at a first damping rate and then at a higher damping rate near the end-of-stroke of the actuator's piston.

In accordance with the invention, the tilt actuator comprises a cylinder, a piston, a piston rod and a damper member. The cylinder has opposite end walls and an inner bore extending between the end walls and adapted to receive fluid therein. The piston is in sliding engagement with the inner bore and divides the inner bore of the cylinder into first and second chambers. The piston has a plurality of damping passages for flow of fluid from the first chamber on one side of the piston to the other chamber on the other side of the piston in a first direction, and each damping passage has a check valve for blocking reverse flow through the damping passage, and each damping passage opening to first chamber at an inlet opening. The rod is connected to the piston and extends through an aperture in one of the end walls of the cylinder, whereby externally forced movement of the rod can cause the piston to move in a second direction opposite the first direction with such movement being dampened by flow of fluid from the first chamber to the second chamber through the damping passages. The damper member is cooperative with the piston in a first position to at least partially block the inlet opening of at least one of the damping passages thereby to restrict flow of fluid from the first chamber to the damping passages in the piston and in a second position that allows full damping flow of fluid to the inlet openings of the damping passages from the first chamber to the damping passages in the piston during movement of the piston in the second direction. In addition, the damper member is disposed within the first chamber such that the damper member is moved from the second position to the first position when the piston moves within a specified distance from the end wall, whereby the damping effect is increased near the end of travel of the piston.

In a particular embodiment, the damper member may have an end face that engages an end face of the piston to close the inlet openings of a plurality of the damping passages. The damper member may span all of the inlet openings of the damping passages when butted against the piston, and the piston may have in the end face thereof at least one side passageway for allowing fluid to flow from the first chamber to the respective inlet passage around the damper member.

The damper member may be connected by a resilient spacer member to the piston, and a resilient pusher member may be interposed between the damper member and the end wall of the cylinder, with the resilient pusher member having a spring constant greater than the spring constant of the resilient spacer member.

In a preferred embodiment, the damper member is connected by a resilient member to an end wall of the cylinder. The resilient member may be a coil spring having one end radially captured in a recess in the end wall of the cylinder and an opposite end captured in a radial recess in the damper member.

According to another aspect of the invention, a tilt actuator for an outboard motor, comprises a cylinder having opposite end walls and an inner bore extending between the end walls and adapted to receive fluid therein; a piston in sliding engagement with the inner bore and dividing the inner bore of the cylinder into first and second chambers, the piston having a plurality of damping passages for flow of fluid from the first chamber on one side of the piston to the other chamber on the other side of the piston in a first direction, each damping passage having a check valve for blocking reverse flow through the damping passage, and each damping passage opening to first chamber at an inlet opening; a rod connected to the piston and extending through an aperture in one of the end walls of the cylinder, whereby externally forced movement of the rod can cause the piston to move in a second direction opposite the first direction with such movement being dampened by flow of fluid from the first chamber to the second chamber through the damping passages; and end-of-stroke damper means for increase the orifice effect of the damping passages near the end of the piston stroke.

The orifice effect may be increased by more than about 30% and the increase in the orifice effect may be provided during about the last 50% of the stroke of the piston or during the last 33% of the stroke of the piston. Generally, the desired damping increase and stroke segment can be tailored to a particular application, and thus may vary from one application to the next.

The foregoing and other features of the invention are hereinafter more fully described and particularly pointed out in the claims, the following description setting forth in detail certain illustrative embodiments of the invention, these being indicative, however, of but a few of the various ways in which the principles of the invention may be employed.

DETAILED DESCRIPTION

Figure 1:
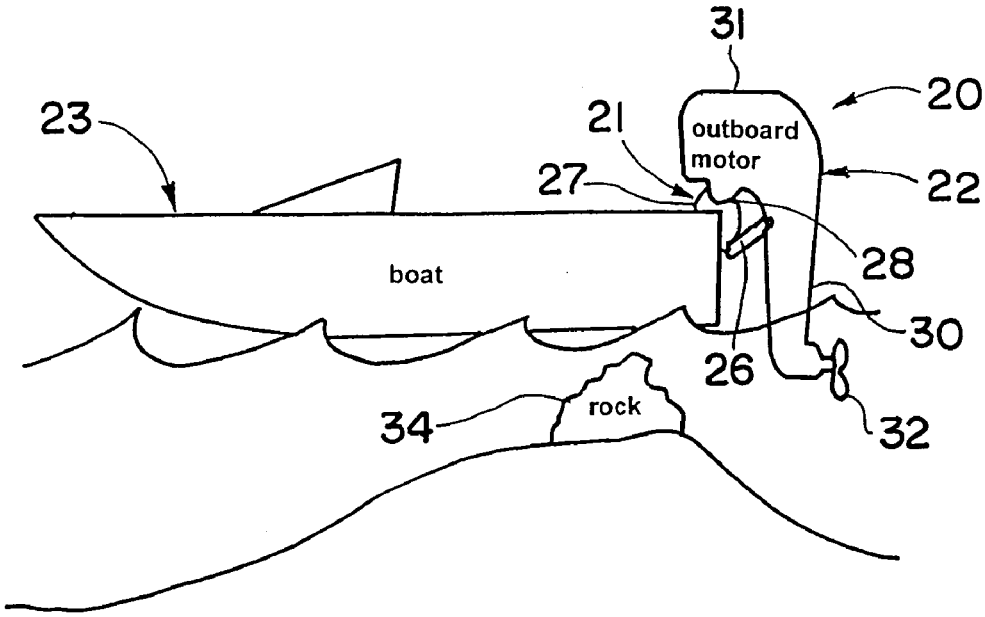
FIG. 1 is a schematic illustration of a boat being propelled by an outboard motor, the motor being shown in a lowered position just prior to impacting a submerged obstruction.

Referring now in detail to the drawings and initially to FIG. 1, an outboard motor 20 may be equipped with a tilt and trim mechanism 21 for tilting and trimming the motor drive assembly 22. The motor drive assembly can be tilted to an up position for launching, retrieving, servicing or trailering, and to a down position for use in propelling a marine vessel such as a boat 23. During boat operation the tilt and trim mechanism 21 can be used to adjust the trim of the motor for optimum boat performance and handling, or for other reasons such as to accommodate shallow water.

Figure 3:
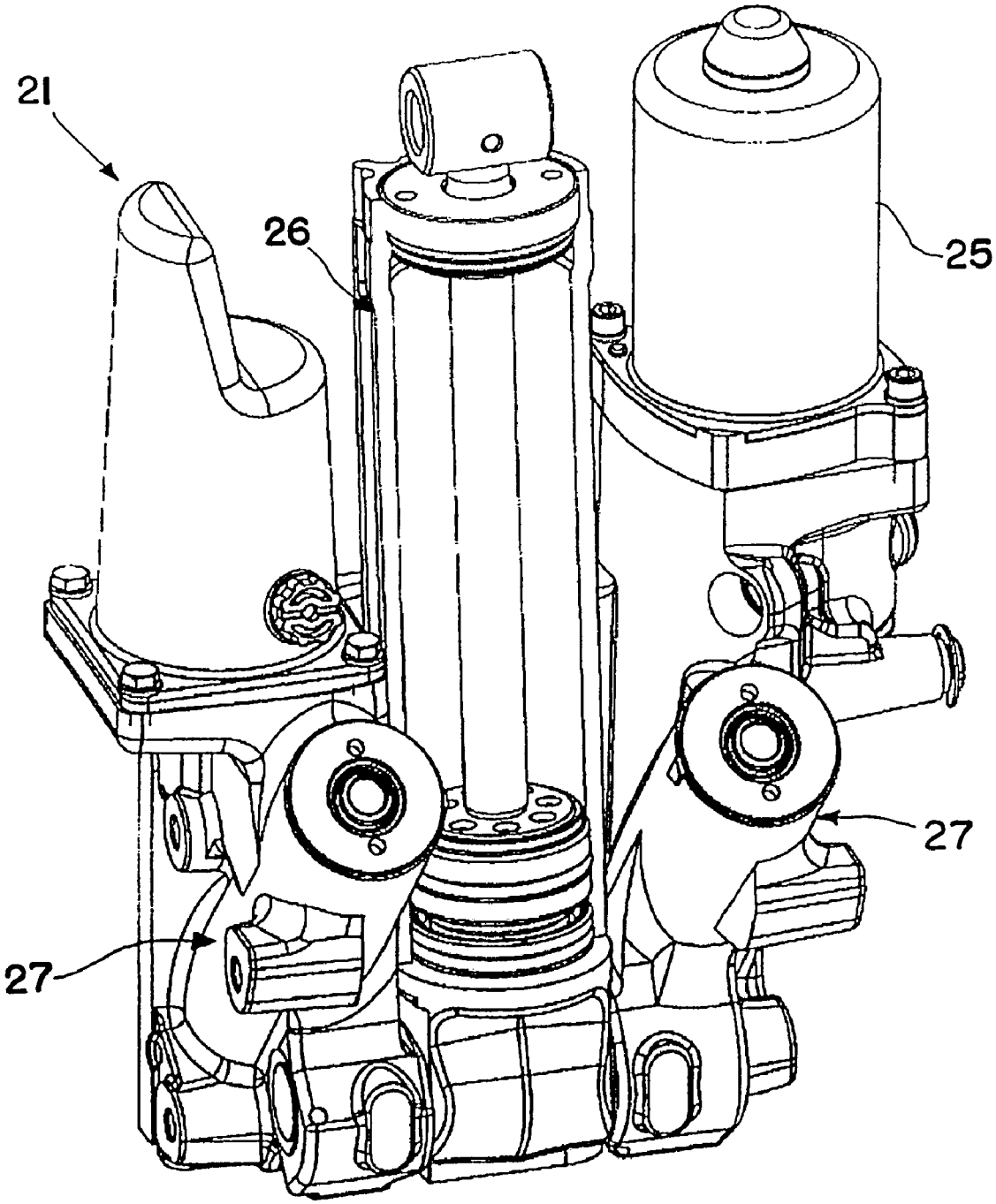
FIG. 3 is a perspective view, partly broken away in section, of a conventional tilt and trim mechanism for the outboard motor.

As seen in FIG. 3, and tilt and trim mechanism may include a DC motor driven hydraulic pump 25, a hydraulic tilt piston-cylinder assembly 26 and hydraulic trim piston-cylinder assemblies 27, such as the two shown on each side of the tilt piston-cylinder assembly. The trim piston-cylinder assemblies 27 are extendable and retractable to trim the drive assembly 22 up or down through a relatively limited angular range, such as about 20 degrees, as is conventional. The tilt piston-cylinder assembly 26 provides for tilt adjustment over a relatively wide range, such as about 70 degrees.

The tilt piston-cylinder assembly 26 may be pivotally connected at its cylinder end to a mounting bracket or housing 27 attached to the back of the boat 23 as seen in FIG. 1, and at its rod end to the drive assembly that is pivotally connected by a pivot mount 28 to the mounting bracket or housing 27. The pivot mount 28 supports a drive shaft housing 30 through which a drive shaft or other force transmission component extends. The drive shaft or other force transmission component drivingly connects a prime mover, such as an internal combustion engine 31, to a propeller 32 mounted at the lower end of the drive shaft housing 30. The engine may be carried by the pivot mount as shown or located in the boat as in the case of an inboard-outboard motor.

Figure 2:
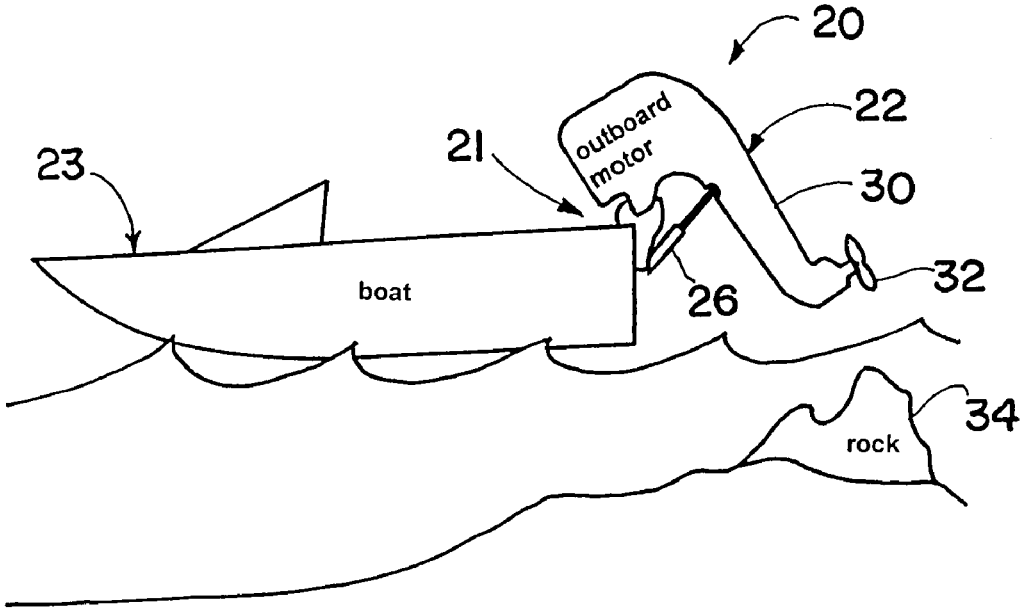
FIG. 2 is a schematic illustration similar to FIG. 1, but showing the motor after impact and in a popped up position clearing the obstruction and with the piston-cylinder assembly of the actuator in an extended condition.

During normal operation the lower end of the motor's drive shaft housing 30 will extend to a level lower than the bottom of the boat 23 where it might encounter an underwater obstruction such as a submerged log or rock 34. To protect the motor from damage, and particularly the propeller 32 at the bottom end of the drive shaft housing, hydraulic tilt piston-cylinder assembly 26' preferably is provided with a shock absorbing/damping feature that allows the motor drive assembly 22 to tilt up and clear of the underwater obstruction as shown in FIG. 2.

Figure 4:
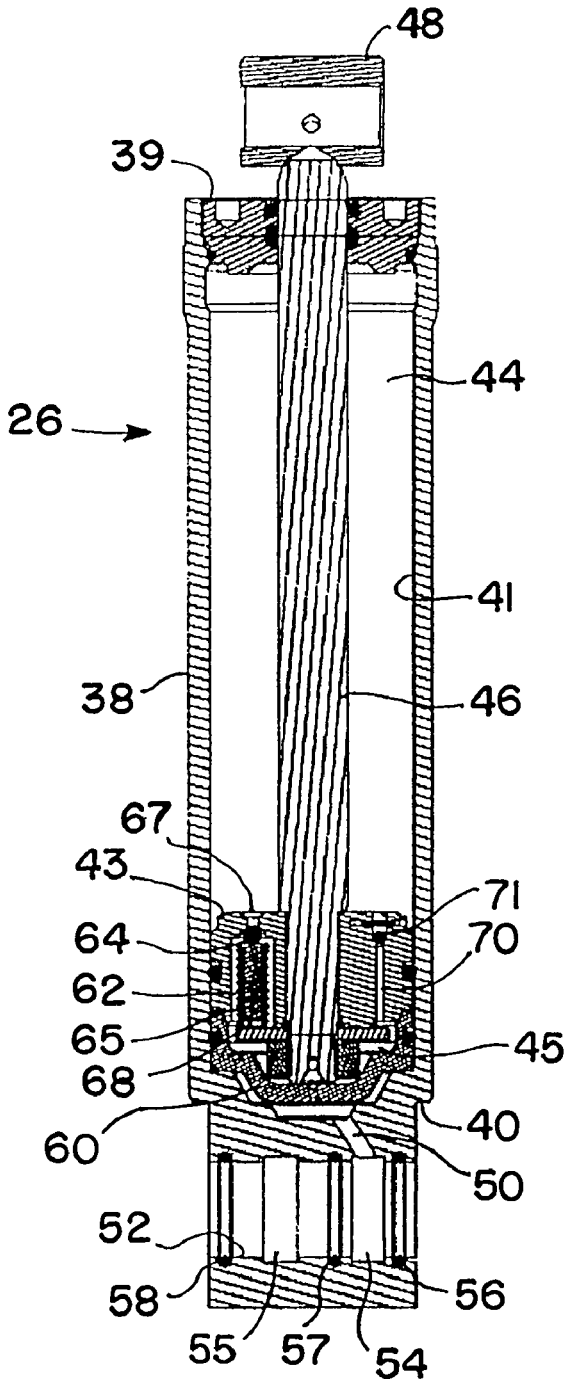
FIG. 4 (Prior Art)
FIG. 4 is a cross-sectional view of a conventional tilt piston-cylinder assembly used in the mechanism of FIG. 4

Referring now to FIG. 4, an exemplary hydraulic piston-cylinder assembly 26 according to the invention can be seen to comprise a cylinder 38 having opposite end walls, i.e., rod and piston end walls 39 and 40, and an inner bore 41 extending between the end walls, a piston 43 in sliding engagement with the inner bore and dividing the inner bore of the cylinder into first and second chambers 44 and 45, and a rod 46 connected to the piston and extending through a sealed aperture in the rod end wall 39 of the cylinder 38. The outer end of the rod 46 is configured for attachment to the pivot mount or other part of the outboard motor that pivots relative to the mounting bracket 27 (FIG. 1) such that extension and retraction of the rod from the cylinder will cause the drive assembly 22 (FIG. 1) to pivot between lowered and raised positions or, conversely, pivoting of the drive assembly between lowered and raised positions will cause the rod to extend or retract from the cylinder. In the illustrated embodiment, the piston-cylinder assembly is configured and mounted such that the rod will be retracted when the drive assembly is in its lowered position, and the rod end may be provided with an attaching eye 48.

The piston end wall 40 of the cylinder 38 is configured for attachment to the mounting bracket 27 (FIG. 1) and includes a flow passage 50 for connecting one end of the cylinder bore to the pump 25 (FIG. 3) or a reservoir whereby pressurized hydraulic fluid can be supplied to or discharged from the cylinder 38 for extension or retraction of the piston-cylinder assembly. Although not shown, the cylinder may have extending along the length thereof another flow passage connected to the other end of the cylinder bore 41 likewise for supplying pressurized fluid to or discharging pressurized fluid from the first chamber 44 for retraction or extension of the piston-cylinder assembly. In the illustrated embodiment, the piston end wall includes a transverse bore 52 for pivotal receipt of a pivot pin (not shown), and annular recesses 54 and 55 and seals 56-58 are provided in the bore in a known manner for coupling the flow passages in the cylinder to the pump and/or reservoir via a control valve or valves. Any suitable means, however, may be employed to provide the hydraulic coupling between the cylinder and the pump and reservoir of the assembly.

As shown in FIG. 4, the piston-cylinder assembly also has a memory piston 60 disposed in the cylinder bore 41 between the piston 43 and the piston end wall 40. The function of the memory piston will become apparent from the following description.

To provide for pressure relief in the event of a low or high speed impact of the drive shaft housing with an obstruction, the piston 43 has a plurality of damping passages 62 for flow of fluid from the first chamber 44 to the second chamber 45 on the other side of the piston. Each damping passage defines a flow restricting orifice and has a check valve for blocking reverse flow through the damping passage. The check valve may include, for example, a ball 64 biased against a valve seat by a spring 65. The damping passages may extend axially through the piston and open to the opposite sides of the piston at respective inlet and outlet openings 67 and 68.

In the event the drive assembly 22 (FIG. 1) strikes an obstruction 34 (FIG. 1) as the boat 23 (FIG. 1) is being propelled in forward direction through the water, the obstruction will cause a large tensile force to be applied to the rod 46 as the drive assembly is forcibly swung rearwardly and upwardly. Such swinging movement is permitted by passage of fluid in the first chamber 44 to the second chamber 45 through the damping passages 62. Because of the flow restricting effect of the damping passages, energy will be dissipated thereby damping the swinging movement of the drive assembly.

After the obstruction in the water has been cleared by the drive assembly, it is desirable that the drive assembly return to its original position thereby allowing an operator to regain steering control. To this end, the piston 43 includes a return passage 70 that allows fluid to flow back from the second chamber to the first chamber until the piston contacts the memory piston. A check valve 71 is provided in the return passage to prevent reverse flow through the return passage.

While the foregoing arrangement is satisfactory for a low speed impact, a problem arises in the event of a high speed impact. The dynamic characteristics of a high speed impact causes high initial impact loads. This causes high pressure in the first chamber 44 of the piston-cylinder assembly 26 because of the orifice effect of the damping passages 62. If the orifice effect is designed to provide sufficient yielding to the initial impact loads, a risk arises that the piston will bottom out against the rod end wall 39 and transfer large loads to the motor's structural components with resultant damage to such components.

To prevent bottoming out of the piston in accordance with the present invention, a damper assembly is provided to in effect increase the orifice effect of the damping passages near the end of the piston stroke. The orifice effect may be increased by more than about 30%, more preferably by about 40%, and most preferably by about 50%. The increase may be provided during about the last 50%, 33% or 25% of the stroke of the piston.

The damper assembly includes a damper member that preferably is cooperative with the piston in a first position to at least partially block the inlet opening of at least one of the damping passages thereby to restrict flow of fluid from the first chamber to the damping passages in the piston and in a second position that allows full damping flow of fluid to the inlet openings of the damping passages from the first chamber during movement of the piston toward the rod end wall. The damper member is disposed within the first chamber such that the damper member is moved from the second position to the first position when the piston moves within a specified distance from the end wall, whereby the damping effect is increased near the end of travel of the piston.

Figure 5:
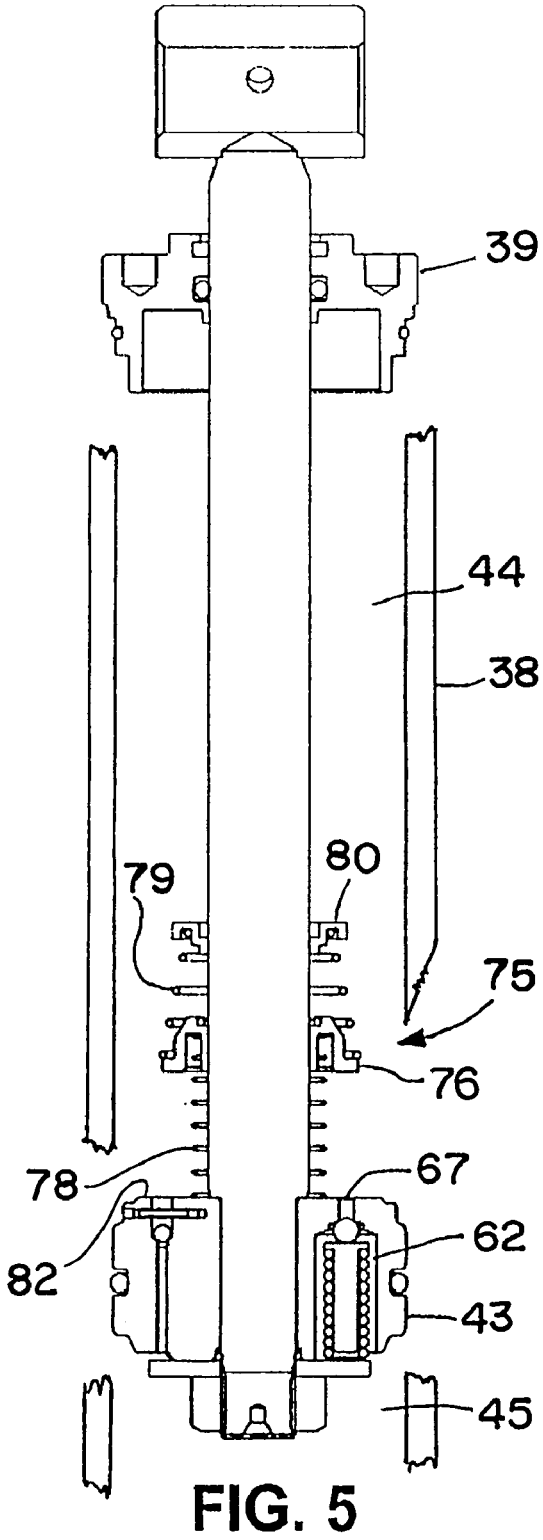
FIG. 5 is a cross-sectional view of the tilt piston-cylinder assembly provided with an end-of-stroke damper assembly according to the present invention, but with portions of the cylinder of the piston-cylinder assembly removed except for its rod end wall.

Referring now to FIG. 5, the above-described piston-cylinder assembly 26 can be seen to be provided with a damper assembly 75 according to the present invention. In this embodiment, the damper assembly includes a damper member, such as a damper plate 76, that is interposed between the piston 43 and rod end wall 39 of the cylinder 38. A resilient spacer member, such as a coil spring 78, is connected between the damper plate and the piston, and a resilient pusher member, such as a conical spring 79, is connected to the side of the damper plate facing the rod end wall 39. The pusher coil spring 79 may have a striker plate 80 connected to its end nearest the end wall 39 of the cylinder as shown. The spring rate of the pusher spring 79 is greater than the spring rate of the spacer spring 78 such that upon compression of the springs between the piston 43 and the end wall 39 of the cylinder, the damper plate will be urged into abutment with the piston before the piston reaches the end of its stroke, such as during the last 1.5 inch of stroke of the piston that has an overall stroke of about 6.6 inches, for example.

The piston-cylinder assembly 26 will function as above-described until the piston 43 nears the rod end wall 39. Under high impact conditions, the striker plate 80 will engage the end wall 39 and this will cause the damper plate 76 to move toward piston 43. When the spring force of the pusher spring 79 exceeds that of the spacer spring 78, the damper plate will be moved into abutment with the end face 82 of the piston. In this position the damper plate will block the openings 67 to one or more of the damping passages 62. For example, the damper plate may block half of the damping passages thereby double the collective damping effect of the damping passages.

Figure 6:
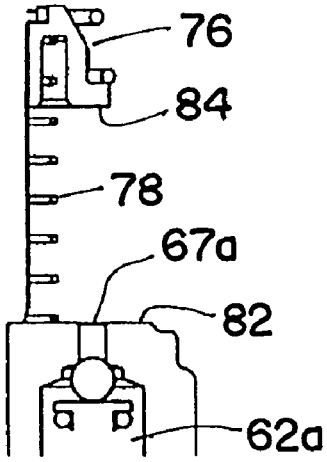
FIG. 6 is an enlarged cross-sectional view of a portion of the damper assembly and piston.
Figure 7:
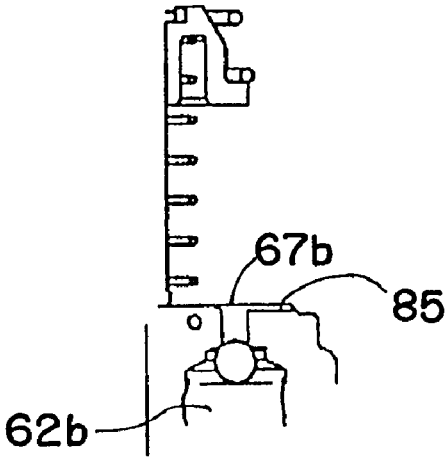
FIG. 7 is an enlarged cross-sectional view similar to FIG. 6, but taken along a different diametral plane intersecting a different damping passage in the piston.
Figure 8:
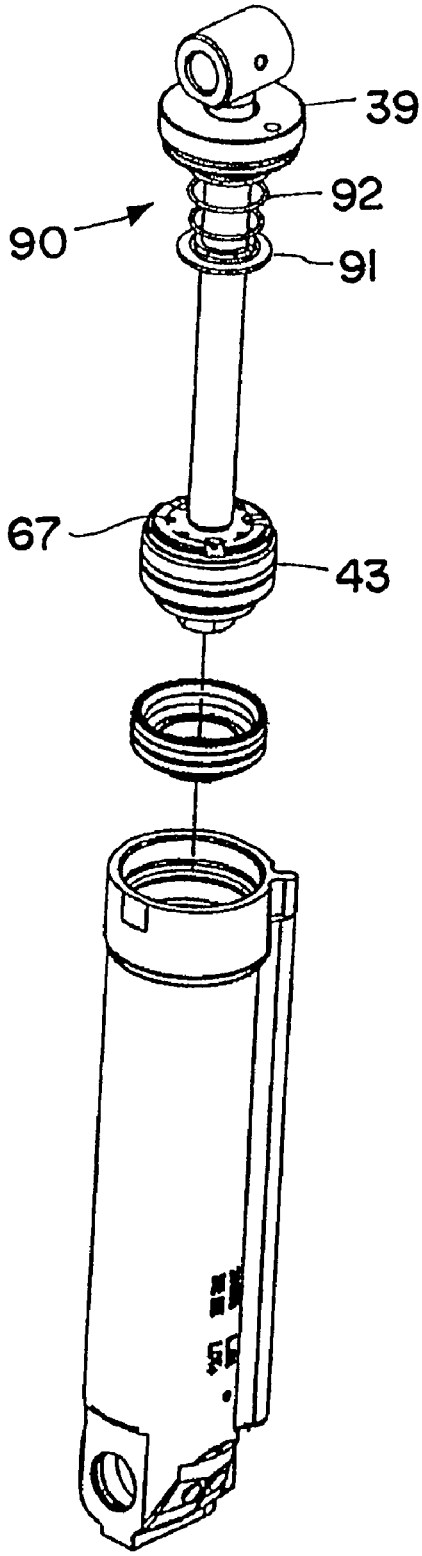
FIG. 8 is an exploded perspective view of the piston-cylinder assembly provided with another end-of-stroke damper assembly according to the invention.
Figure 9:
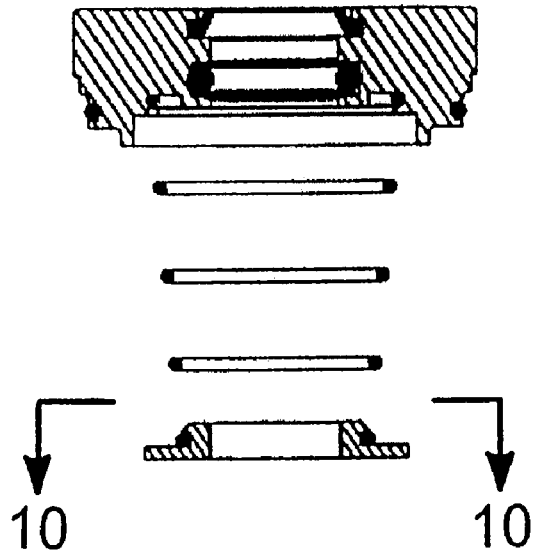
FIG. 9 is a cross-sectional view of the damper assembly used in the piston-cylinder assembly of FIG. 8.
Figure 10:
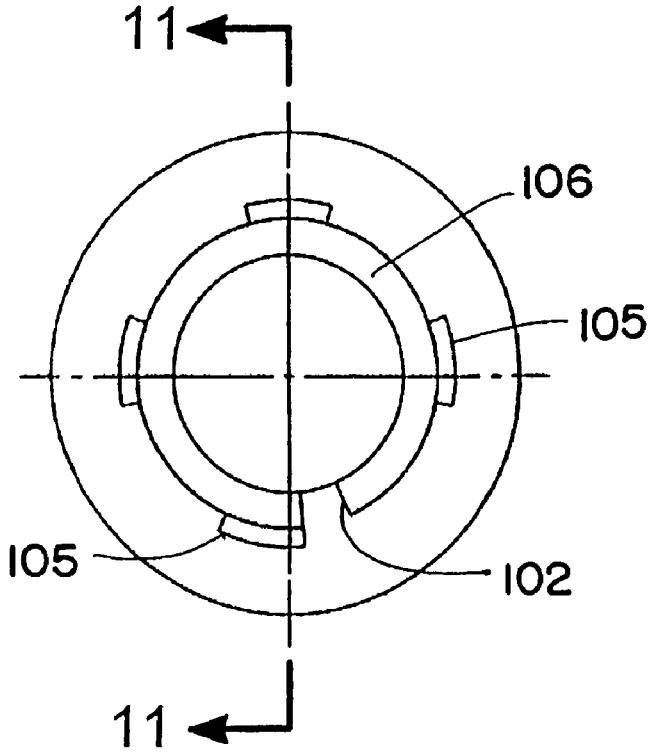
FIG. 10 is a end view of a damper plate used in the damper assembly of FIG. 9, taken along the line 10-10 thereof.
Figure 11:
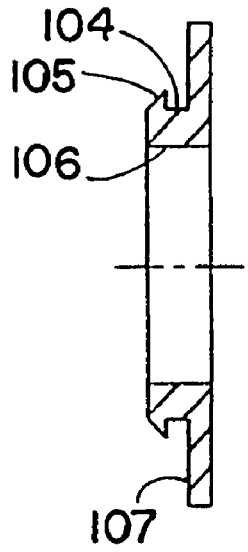
FIG. 11 is a cross-sectional view of the valve closure unit taken along the line 11-11 of FIG. 10.
Figure 12:
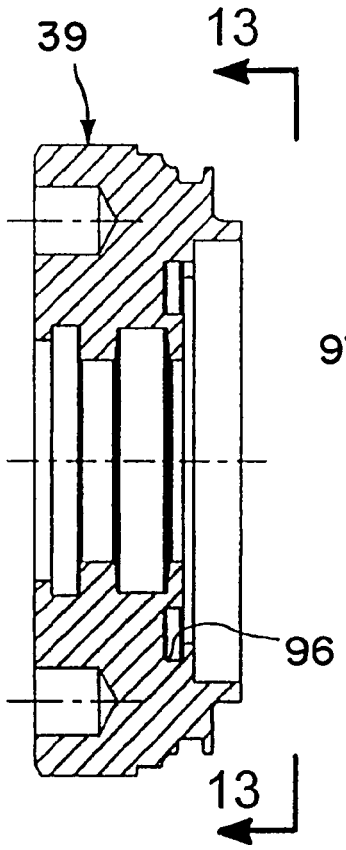
FIG. 12 is a cross-sectional view of the end cap.
Figure 13:
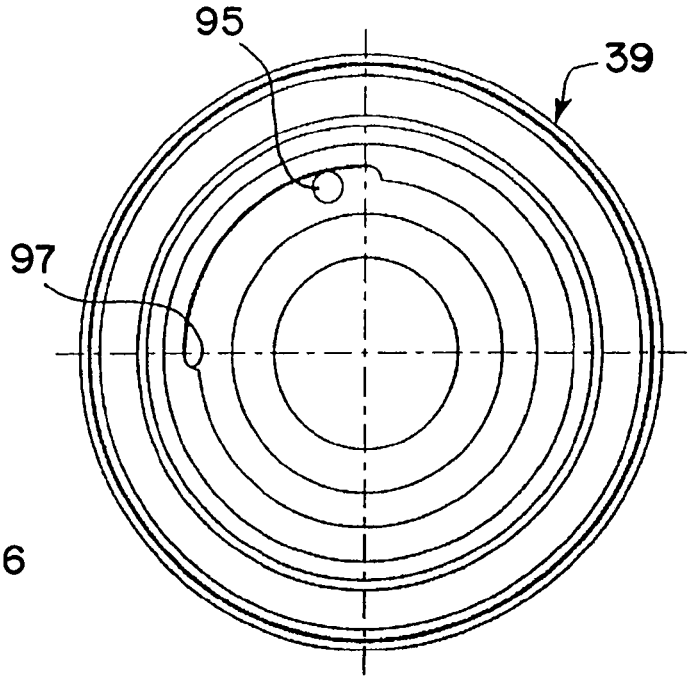
FIG. 13 is a plan view of the inner side of the rod end cap taken along the line 13-13 of FIG. 12.
Figure 14:
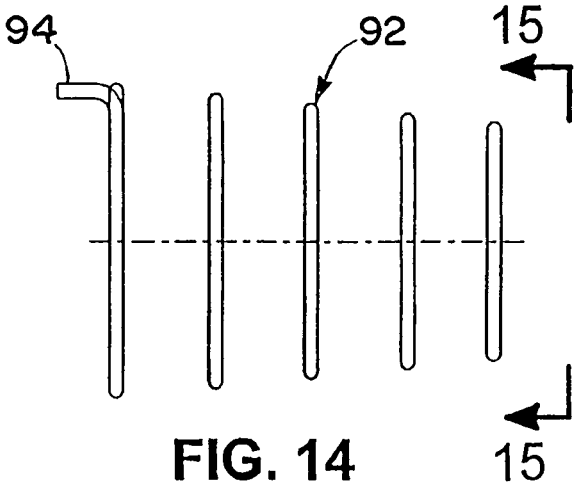
FIG. 14 is a side elevational view of a spring used in the damper assembly of FIG. 9.
Figure 15:
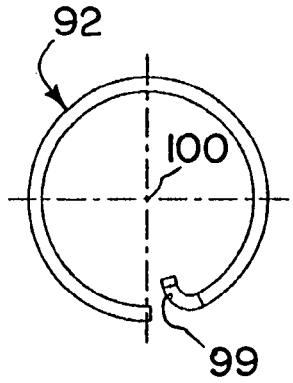
FIG. 15 is an end view of the spring taken along the line 15-15 of FIG. 14.

As seen in FIG. 6, the inlet opening 67*a* of some of the damping passages 62*a* is flush to the end face of the piston that will be engaged by an opposed end face 84 of the damper plate 76. When engaged, the end face of the damper engages the piston end face and flow to the damping passage will be substantially impeded. As seen in FIG. 7, the inlet opening 67*b* of other damping passages 62*b* are provided with a side passageway 85 that will allow fluid to flow from the first chamber into damping passage 62*b* for effecting the above-described damping function. Every other damping passage, for example, may be provided with the side passageway 85 whereby half of the damping passages will be blocked by the damper plate and the other half left open.

Other configurations may also be employed to provide for the effective increase of the damping effect of the damping passages. For example, all of the inlet openings of the damping passages may be partially closed (blocked) by the damping plate to restrict flow through all of the damping passages. In another arrangement, the damper plate may be provided with holes that align with just some of the inlet openings of the damping passages whereby those opening will be left open and others closed, but provision would be needed to maintain the alignment of the holes with the inlet openings.

Referring now to FIGS. 8-15, another embodiment of a damper assembly according to the invention is shown. In this embodiment the damper assembly 90 includes a damper plate 91 that is attached to the rod end wall 39 of the cylinder 38 by a resilient member, such as a conical spring 92. The damper plate 91 may be the same as that described above in relation to the embodiment shown in FIGS. 5-7, and it may interact with the piston 43 in essentially the same manner to block or restrict flow to at least some of the inlet openings 67 of the damping passages in the piston 43 when the damping plate abuts the piston. The damper assembly of FIGS. 8-15, however, is more compact, i.e. a smaller package, than the damper assembly of FIGS. 5-7.

The conical spring 92 preferably is locked to the end cap and damper plate 91 against separation during use. In the illustrated exemplary embodiment, tab 94 on the end of the conical spring 92 may be inserted into a hole 95 in the end cap 39. This allows the spring to be rotated to reduce the diameter of the last coil of the spring, thereby allowing the last turn of coil to be inserted into a radially undercut groove 96. When release, the outermost turn will expand into and be captured in the groove where it will be securely held against separation from the end caps. In this manner, the spring may be installed with no added fasteners as is desired, although other means of attachment may also be employed. The end cap also has a relieved slot 97 that allows the next advancing coil to exit out of the spring groove.

The other end of the spring may have a tab 99 that is turned inwardly toward the center axis 100 of the spring 92 such that when the spring is snapped or otherwise assembled on the damper plate it may be inserted in a radial slot 102 on the damper plate. This is done so that the conical spring cannot rotate off (unscrew) from the damper plate. The outermost turn is captured in radially outwardly opening grooves 104 formed by tabs 105 protruding radially outwardly from a hub portion 106 of the damper plate and axially spaced from a radial flange surface 107. The tabs 105 may have beveled ends to facilitate passage of the coil from thereover. Such arrangement provides for secure attachment without the need for separate fasteners, as is desired, although other means of attachment may also be employed.

Although the invention has been shown and described with respect to a certain embodiment or embodiments, it is obvious that equivalent alterations and modifications will occur to others skilled in the art upon the reading and understanding of this specification and the annexed drawings. In regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A tilt actuator for adjusting the trim or tilt of an outboard motor, comprising:

a cylinder having opposite end walls and an inner bore extending between the end walls and adapted to receive fluid therein;

a piston in sliding engagement with the inner bore and dividing the inner bore of the cylinder into first and second chambers, the piston having a plurality of damping passages for flow of fluid from the first chamber on one side of the piston to the other chamber on the other side of the piston in a first direction, each damping passage having a check valve for blocking reverse flow through the damping passage, and each damping passage opening to the first chamber at an inlet opening;

a rod connected to the piston and extending through an aperture in one of the end walls of the cylinder, whereby externally forced movement of the rod can cause the piston to move in a second direction opposite the first direction with such movement being dampened by flow of fluid from the first chamber to the second chamber through the damping passages; and a damper member cooperative with the piston in a first position to at least partially block the inlet opening of at least one of the damping passages thereby to restrict flow of fluid from the first chamber to the damping passages in the piston and in a second position that allows full damping flow of fluid to the inlet openings of the damping passages from the first chamber to the damping passages in the piston during movement of the piston in the second direction, the damper member being disposed within the first chamber such that the damper member is moved from the second position to the first position when the piston moves within a specified distance from the end wall, whereby the damping effect is increased near the end of travel of the piston, and wherein such movement of the damper member is effected by a resilient member through interaction with the chamber.

2. A tilt actuator according to claim 1, wherein the damper member is connected by a resilient spacer member to the piston.

3. A tilt actuator according to claim 2, wherein a resilient pusher member is interposed between the damper member and the end wall of the cylinder, and the pusher member has a spring constant greater than the spring constant of the resilient spacer member.

4. A tilt actuator for adjusting the trim or tilt of an outboard motor, comprising:

a cylinder having opposite end walls and an inner bore extending between the end walls and adapted to receive fluid therein;

a piston in sliding engagement with the inner bore and dividing the inner bore of the cylinder into first and second chambers, the piston having a plurality of damping passages for flow of fluid from the first chamber on one side of the piston to the other chamber on the other side of the piston in a first direction, each damping passage having a check valve for blocking reverse flow through the damping passage, and each damping passage opening to the first chamber at an inlet opening;

a rod connected to the piston and extending through an aperture in one of the end walls of the cylinder, whereby externally forced movement of the rod can cause the piston to move in a second direction opposite the first direction with such movement being dampened by flow of fluid from the first chamber to the second chamber through the damping passages; and a damper member cooperative with the piston in a first position to at least partially block the inlet opening of at least one of the damping passages thereby to restrict flow of fluid from the first chamber to the damping passages in the piston and in a second position that allows full damping flow of fluid to the inlet openings of the damping passages from the first chamber to the damping passages in the piston during movement of the piston in the second direction, the damper member being disposed within the first chamber such that the damper member is moved from the second position to the first position when the piston moves within a specified distance from the end wall, whereby the damping effect is increased near the end of travel of the piston, and wherein the damper member has an end face that engages an end face of the piston to close the inlet openings of a plurality of the damping passages.

5. A tilt actuator according to claim 4, wherein the damper member spans all of the inlet openings of the damping passages when butted against the piston, and the piston has in the end face thereof at least one side passageway for allowing fluid to flow from the first chamber to the respective inlet passage around the damper member.

6. A tilt actuator for adjusting the trim or tilt of an outboard motor, comprising:

a cylinder having opposite end walls and an inner bore extending between the end walls and adapted to receive fluid therein;

a piston in sliding engagement with the inner bore and dividing the inner bore of the cylinder into first and second chambers, the piston having a plurality of damping passages for flow of fluid from the first chamber on one side of the piston to the other chamber on the other side of the piston in a first direction, each damping passage having a check valve for blocking reverse flow through the damping passage, and each damping passage opening to the first chamber at an inlet opening;

a rod connected to the piston and extending through an aperture in one of the end walls of the cylinder, whereby externally forced movement of the rod can cause the piston to move in a second direction opposite the first direction with such movement being dampened by flow of fluid from the first chamber to the second chamber through the damping passages; and a damper member cooperative with the piston in a first position to at least partially block the inlet opening of at least one of the damping passages thereby to restrict flow of fluid from the first chamber to the damping passages in the piston and in a second position that allows full damping flow of fluid to the inlet openings of the damping passages from the first chamber to the damping passages in the piston during movement of the piston in the second direction, the damper member being disposed within the first chamber such that the damper member is moved from the second position to the first position when the piston moves within a specified distance from the end wall, whereby the damping effect is increased near the end of travel of the piston, and wherein the damper member is connected by a resilient member to the end wall of the cylinder.

7. A tilt actuator according to claim 6, wherein the resilient member is a coil spring, and one end of the coil spring is radially captured in a recess in the end wall of the cylinder and an opposite end of the coil spring is captured in a radial recess in the damper member.

* * * * *